US006050328A

United States Patent [19]

Shikazono et al.

[11] Patent Number: 6,050,328

[45] Date of Patent: Apr. 18, 2000

[54] HEAT EXCHANGER AND AIR CONDITIONER USING SAME

[75] Inventors: Naoki Shikazono, Ibaraki-ken; Toshio Hatada, Tsuchiura; Masaaki Itoh, Tsuchiura; Hideyuki Kimura, Tsuchiura; Sumiyoshi Takeda; Kensaku Oguni, both of Shimizu; Hiromu Yasuda, Shizuoka; Minetoshi Izushi, Shimizu; Minoru Sato, Shimizu; Tatsuya Sugiyama, Shimizu, all of Japan

[73] Assignee: Hitachi, Ltd., Tokyo, Japan

[21] Appl. No.: 09/015,546

[22] Filed: Jan. 29, 1998

[30] Foreign Application Priority Data

Jan. 30, 1997 [JP] Japan ..... 9-016231

[51] Int. Cl.[7] ..... F24H 3/02

[52] U.S. Cl. ..... 165/121; 165/151; 165/181

[58] Field of Search ..... 165/121, 53, 125, 165/172, 151, 181, 182, 177, 179

[56] References Cited

U.S. PATENT DOCUMENTS

| | | | |
|---|---|---|---|
| 1,709,176 | 4/1929 | Hyde | 165/125 |
| 1,992,646 | 2/1935 | Young | 165/182 |
| 2,089,340 | 8/1937 | Cobb | 165/182 |
| 2,402,262 | 6/1946 | Sewell | 165/182 |
| 2,620,171 | 12/1952 | Dubin et al. | 165/182 |
| 2,868,515 | 1/1959 | Garland | 165/150 |
| 3,537,516 | 11/1970 | Kunz | 165/181 |
| 3,847,213 | 11/1974 | Stich | 165/181 |
| 4,173,998 | 11/1979 | Jahoda | 165/182 |
| 4,434,841 | 3/1984 | Jackson et al. | 165/125 |
| 4,691,768 | 9/1987 | Obosu | 165/151 |
| 4,723,599 | 2/1988 | Hanson | 165/151 |
| 4,877,087 | 10/1989 | Hill | 165/181 |
| 4,928,756 | 5/1990 | Shull et al. | 165/182 |
| 5,046,556 | 9/1991 | Anderson | 165/181 |
| 5,117,905 | 6/1992 | Hesse | 165/182 |
| 5,201,367 | 4/1993 | Dubrovsky et al. | 165/151 |
| 5,482,115 | 1/1996 | Ikeya et al. | 165/151 |
| 5,501,270 | 3/1996 | Young et al. | 165/151 |
| 5,509,469 | 4/1996 | Obosu | 165/151 |
| 5,582,246 | 12/1996 | Dinh | 165/181 |

FOREIGN PATENT DOCUMENTS

| | | | |
|---|---|---|---|
| 603073 | 11/1928 | France | 165/181 |
| 2029358 | 10/1970 | France | 165/181 |
| 4-93594 | 3/1992 | Japan | 165/182 |
| 340765 | 1/1931 | United Kingdom | 165/181 |

*Primary Examiner*—Ira S. Lazarus
*Assistant Examiner*—Terrell McKinnon
*Attorney, Agent, or Firm*—Antonelli, Terry, Stout & Kraus, LLP

[57] ABSTRACT

A heat exchanger composed by overlapping a plurality of heat exchanger units each of which is formed by inserting a plurality of fins over one or a plurality of heat transfer tubes. The fins are worked so that a pair of opposed fins of the overlapped heat exchanger units are brought into contact with each other at one or more points. This heat exchanger constitutes an air conditioner when the heat exchanger units are overlapped in a direction of gravity.

10 Claims, 10 Drawing Sheets

HEAT EXCHANGER AND AIR CONDITIONER USING SAME

BACKGROUND OF THE INVENTION

1. Field of the Invention

The present invention relates to a heat exchanger to be used, for example, in refrigerator/air conditioners, and more particularly a finned heat transfer tube provided on an external surface thereof with fins for promoting heat conduction, a heat exchanger and a refrigerator/air conditioner.

2. Description of the Related Art

Japanese Patent Examined Publication No. 52-42255 (Literature 1) and Japanese Patent Unexamined Publication No. 63-197886 (Literature 2) are known as the conventional arts for what we call an independent fin tube heat exchanger in which a plurality of fins each having a through hole are inserted over a heat transfer tube. Literature 1 discloses a method for manufacturing a heat exchanger by forming through holes in a belt-like strip material, forming collars around the through holes, forming fins which have the same shape by cutting the strip material between the through holes, constituting blocks by overlapping the fins in a plurality, passing a heat transfer tube through the through holes after arranging the blocks in a row and forming this heat transfer tube so as to meander by sequentially bending it between the blocks. Further, Literature 2 discloses a heat exchanger provided with a large number of small fins wherein predetermined inter-row pitches are formed by interposing, between inter-row pitches, two heat exchangers which are provided with small fins and heat transfer tubes running through the small fins and are formed by bending the heat transfer tubes so as to meander at a pitch at least twice as large as a fin width in an air low direction of the small fins.

Further, techniques disclosed by Japanese Utility Model Unexamined Publication No. 61-26977 (Literature 3), Japanese Utility Model Unexamined Publication No. 3-31230 (Literature 4) and Japanese Utility Model Unexamined Publication No. 63-74983 (Literature 5) are known as arts (technique) for enhancing water dripping properties of divided heat exchangers. Literature 3 discloses a heat exchanger which has a slanted joined surface in a finned heat exchanger divided into an upper stage and a lower stage is slanted, Literature 4 discloses a heat exchanger in which lower ends of independently formed separate upper and lower fins are slanted, and Literature 5 discloses a heat exchanger in which lower ends of fins are disposed zigzag along rows of heat transfer tubes which are arranged in alternate rows.

The heat exchangers disclosed by Literatures 1 and 2 mentioned above which use the fins separated from each other pose problems that their strengths are lowered when they are piled up as heat exchangers in a direction of gravity and that their dripping properties are low when they are used as evaporators.

On the other hand, the heat exchangers disclosed by Literatures 3 through 5 mentioned above are configured for obtaining enhanced water dripping properties, but raise a problem that water dripping properties cannot be sufficiently enhanced simply by slanting the lower ends of the fins or configuration the lower ends in the zigzag shapes.

SUMMARY OF THE INVENTION

An object of the present invention is to provide an independent fin heat exchanger having fins disposed for each heat transfer tube, wherein strength of the heat exchanger is enhanced while maintaining a desired water dripping property.

Another object of the present invention is to provide an air conditioner which can have desired performance when its casing has various forms.

The object described above can be accomplished by working fins so that a pair of fins of overlapped heat exchanger units are brought into contact with each other at one or more points in a heat exchanger constituted by overlapping a plurality of heat exchanger units each of which has a plurality of fins inserted over one or a plurality of heat transfer tubes.

The other object described above can be accomplished by constituting a heat exchanger by overlapping a plurality of heat exchanger units each of which is provided, by inserting a plurality of fins over one or more heat transfer tubes in the direction of gravity and arranging a heat exchanger unit at an upper stage so as to deviate from a heat exchanger unit at a lower stage.

Other features of the present invention will be apparent from other claims and the following description.

BRIEF DESCRIPTION OF THE DRAWINGS

FIGS. 3A and 3B being plan views showing the independent fin in the course of manufacturing, FIG. 3C being a perspective view of the independent fin and FIG. 3D being a sectional view taken along a IIID—IIID line in FIG. 3B;

DETAILED DESCRIPTION OF THE PREFERRED EMBODIMENTS

Now, embodiments of the present invention will be described with reference to the accompanying drawings.

Figure 1:
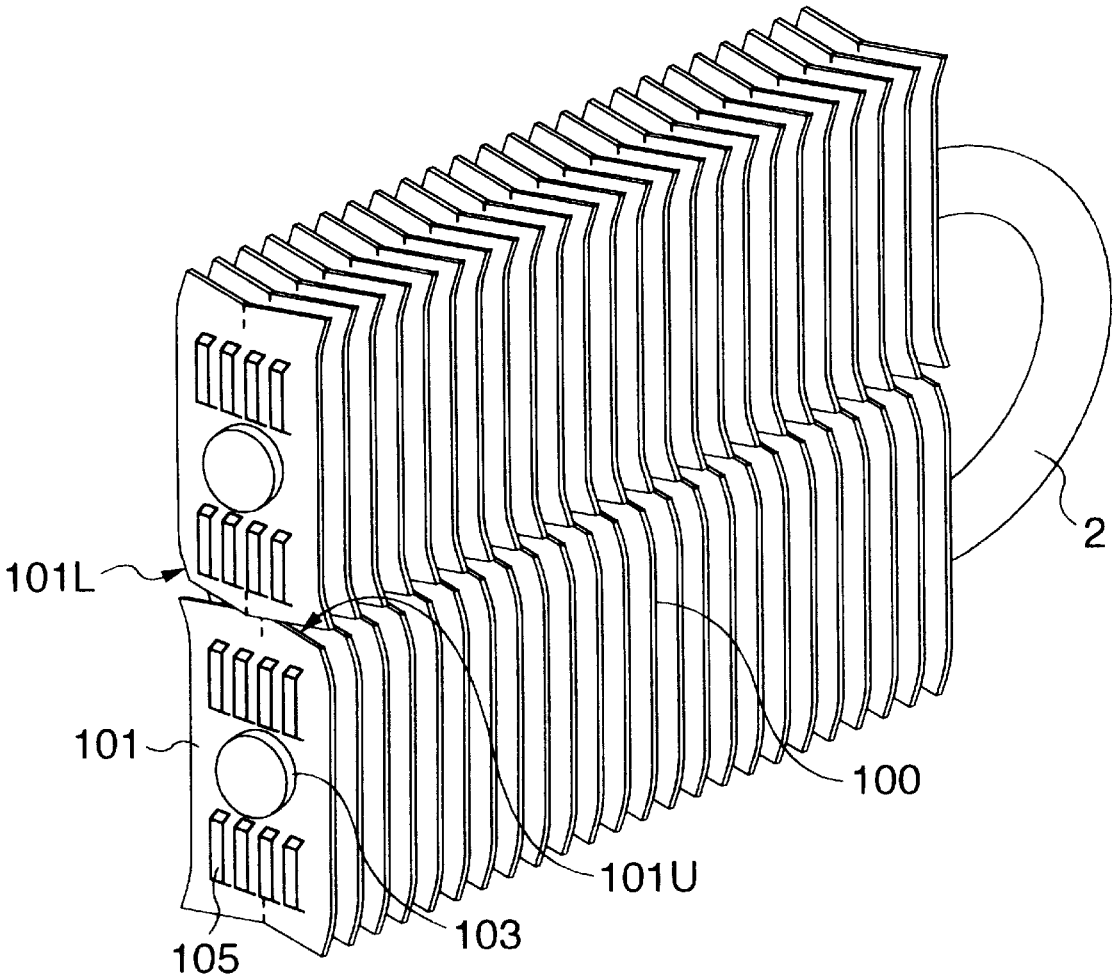
FIG. 1 is a perspective view of an independent fin tube heat exchanger in accordance with an embodiment of the present invention wherein fins have contact portions intersecting with each other.

FIGS. 1 through 4 are views illustrating a first embodiment of the present invention. FIGS. 1, 2A and 2B show a structure of an independent fin tube heat exchanger 100 in accordance with the first embodiment of the present invention, FIG. 1 being a perspective view of the heat exchanger, and FIGS. 2A and 2B being enlarged views of the heat exchanger.

Figure 2A:
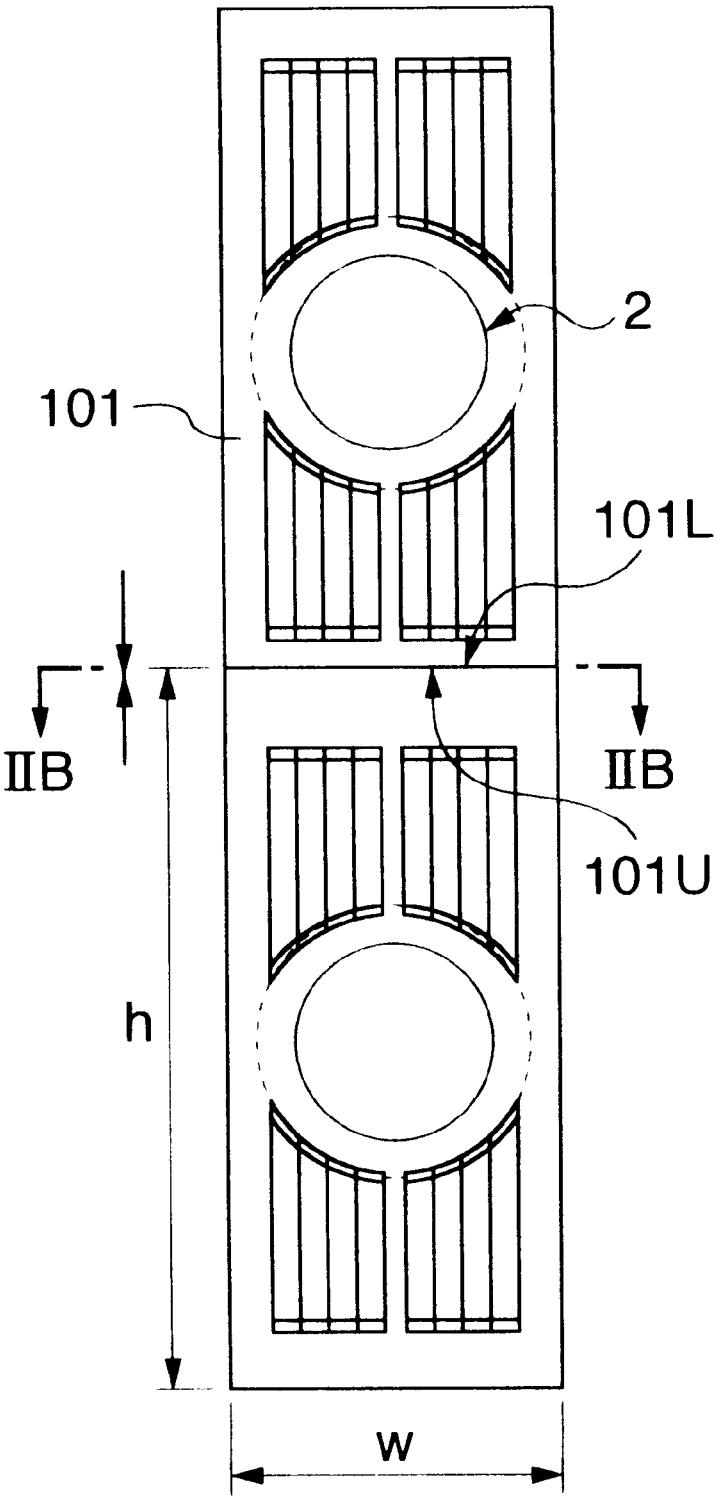
FIG. 2A is an enlarged view of the independent fins shown in FIG. 1.
Figure 2B:
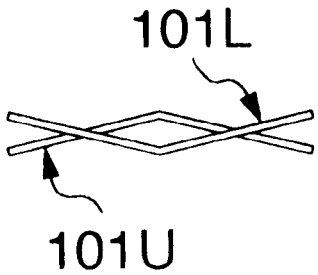
FIG. 2B is a sectional view taken along a IIB—IIB line in FIG. 2A.

In FIG. 1, a heat transfer tube 2 passes through collars 103 formed in independent fins 101 in which slits 105 are formed. Lower ends 101L and upper ends 101U of the fins 101 are bent in directions reverse to each other in a direction of thickness of the fins. Speaking more concretely, only the upper ends 101U and lower ends 101L are bent so as to form peaks and valleys along straight lines connecting centers of shorter sides of the fins. Portions surrounding the collars 103 and the slits 105 are left flat. By bending the lower ends 101L of the fins arranged at an upper stage and the upper ends 101U of the fins arranged at a lower stage in the directions reverse to each other, there is provided a structure in which the fins intersect as shown in FIGS. 2A and 2B as seen in a direction of gravity.

In the heat exchangers disclosed in the Literatures 1 and 2 mentioned above, fins which are disposed at an upper stage and a lower stage for constituting the heat exchangers are not always kept in contact with each other. Accordingly, condensate does not flow along the fins, but are held by the fins, thereby increasing ventilation resistance and reducing an amount of heat to be exchanged when the heat exchangers are used as evaporators.

In the heat exchangers disclosed in the Literatures 3 through 5 which are configured to enhance water dripping properties, on the other hand, lower ends of the fins are slanted or configured so as to have zigzag shapes. Even when the lower ends of the fins are slanted or configured so as to have the zigzag shapes, however, condensate is held by convexities at the lower ends of the fins arranged at upper stages and sufficient water dripping properties are not restored so far as the fins at the upper stages are not brought into complete contact with fins at lower stages.

When an attempt is made to bring the fins at the upper and lower stages into close contact with each other in the heat exchangers disclosed in the Literatures 1 and 2 for enhancing the water dripping properties, the fins at the upper stages may bite between adjacent fins on the heat transfer tubes at the lower stages, thereby raising problems such as narrowing of areas of front surfaces, twisting of the heat transfer tubes and increase in ventilation resistance at the meshing. Further, the heat exchangers have structural strength which is not reinforced by the fins but dependent only on strength of the heat transfer tubes and is lower than that of a cross fin tube type heat exchanger in which a plurality of heat transfer tubes pass through fins. In such cases, the heat exchangers disclosed in the Literatures 1 and 2 may raise problems that they are broken during transit or produce vibrations and noise.

The first embodiment of the present invention, in contrast, allows the fins to be brought into close contact with each other while preventing them from biting each other by arranging the fins so that they intersect on their contact portions as seen in a direction of gravity, or configuring the fins so that a lower end of a fin arranged at an upper stage intersects at least at a point with an upper end of a fin arranged at a lower stage, thereby making it possible to obtain a heat exchanger which has an enhanced water dripping property and is strengthened in the direction of gravity.

It is desirable that the fins are bent for a length corresponding to at least ½ of a pitch of the fins which is a distance between two adjacent fins arranged along the heat transfer tube 2. If the fins are bent for a length shorter than ½ of the pitch, it will be impossible to completely prevent the fins from biting with each other. When the fins are arranged or configured as described above, the fins are always brought into contact at a plurality of points and water flows down by way of the contact points, thereby enhancing a water dripping property. Further, gaps are formed between lower ends of the fins at the upper stage and upper ends of the fins at the lower stage which are bent. Water flowing along the fins at the upper stage grows into water drops at their lower portions. When particle sizes of these water drops become larger than the gaps, they come into contact with the upper ends of the fins at the lower stage, shift to the fins at the lower stage and flow down. This function also enhances the water dripping property. This function is obtained also by embodiments which are described below. This effect is not expectable simply by overlapping straight fins which are not bent unlike those used in the first embodiment of the present invention.

Furthermore, it is possible by pressing the upper and lower fins under a definite pressure to restrict horizontal movement of the fins and enhance strength of the heat exchanger.

In the first embodiment, the fins have a rectangular shape which is elongated in the direction of gravity. From a viewpoint of fin efficiency, it is advantageous to configure fins so as to have a shallow depth so that an area which is supported by the heat transfer tube is small at a definite pitch. It is desirable to select a height h and a depth w of the independent fin so as to satisfy relationship of $h \geqq 1.5\ w$. Similar effects on the water dripping property and strength of the heat exchanger can needlessly be obtained even when the relationship is not satisfied.

Though the ends of the fins are bent in a V shape, the fins may be bent in a W shape or so as to have more concavities and convexities. Further, the fins may be bent not in the V shape but in arc shape (curved). Quite similar effects are obtained also in this case.

Figure 3A:
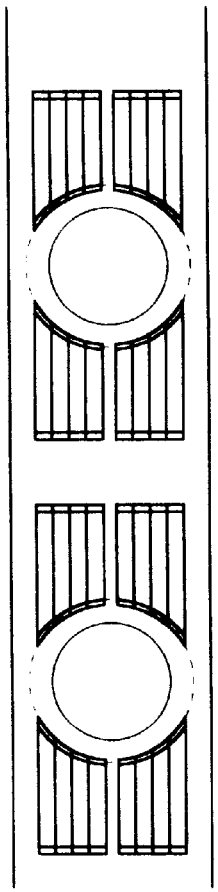
FIGS. 3A through 3D illustrate a manufacturing method of the independent fin shown in FIG. 1.
Figure 3B:
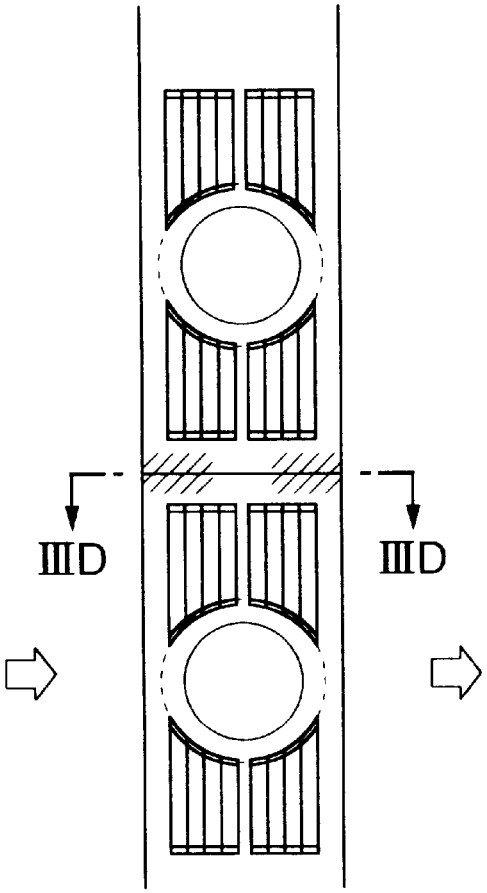
Figure 3C:
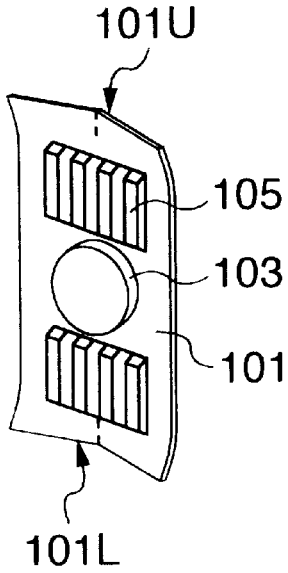
Figure 3D:
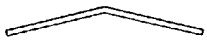

A manufacturing method of the heat exchanger 100 preferred as the first embodiment is illustrated in FIGS. 3A, 3B, 4A and 4B. After cutting a portion which is continuous and corresponds to an end portion of a fin 3 in which the collar 103 and the slit 105 are formed as shown in FIGS. 3A and 3B (a portion hatched in FIG. 3B), concavities and convexities are formed by press work. An independent fin whose upper and lower end are bent as shown in FIG. 3 is thus obtained. In the case of press work, the fin is not necessarily bent at an acute angle at its center but a similar effect can be obtained even when the fin is bent at an angle which is abtuse to a certain degree. Further, the fin may be bent as a whole including the upper and lower ends. It is important that the fin has a depth in a direction of its thickness at the upper and lower ends.

It is possible to perform the cutting and bending work of the fin by preparing a jig having valleys corresponding to portions of a fin which are to be bent, locating the portions of the fin which are to be cut in the vicinities of tips of this jig and cutting the fin by pressing the jig with a cutter having an edge which has the same angle as that of the valley.

Though the portions to be formed as the upper and lower ends of the fins are worked at an accommodation stage into an air conditioner or the like, similar advantageous effects can be obtained by working only the upper or lower ends. In this case, the upper fins will bite between the lower fins if the fins are not bent for a length exceeding a fin pitch which is a distance between adjacent fins arranged along the heat transfer tube.

Figure 4A:
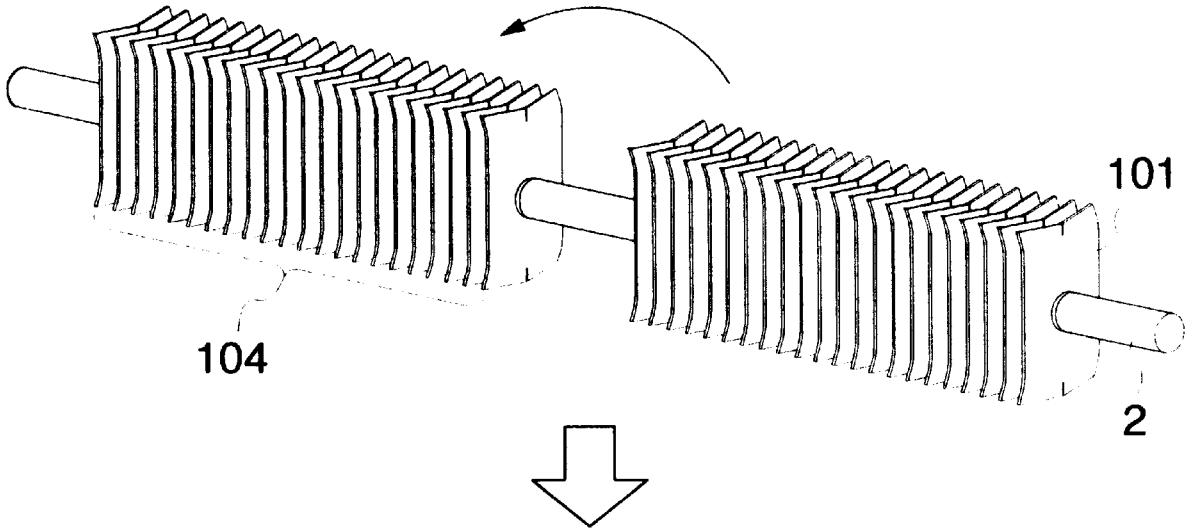
FIGS. 4A and 4B are perspective views illustrating a manufacturing method of the independent fin tube heat exchanger shown in FIG. 1.
Figure 4B:
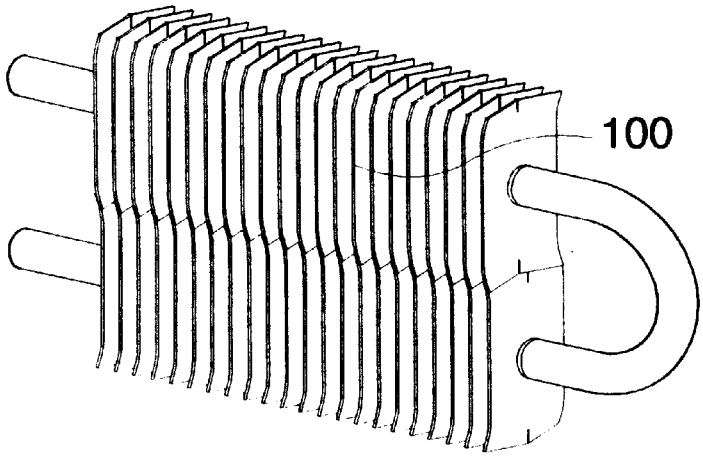

Successively, several fin blocks 104 (heat exchanger units) are formed by inserting the heat transfer tube 2 into the collars 103 of the fins 101 as shown in FIG. 4A. After expanding the heat transfer tube, the heat exchanger 100 is constituted by bending the tube so that the fins are brought into contact with each other as shown in FIG. 4B. A larger heat exchanger can be manufactured by repeating this step. It is possible to obtain a heat exchanger having a structure wherein an upper fin and a lower fin are brought into contact at two points as shown in FIGS. 2A and 2B by inserting and arranging all fins over the heat transfer tube 2 in the same bent direction, and bending the heat transfer tube without changing the direction of the fins.

Though all the fins are bent in the first embodiment described above, all the fins may not be bent when slight degradations of strength and a water dripping property are allowable. This is true for other embodiments that follow.

Figure 5A:
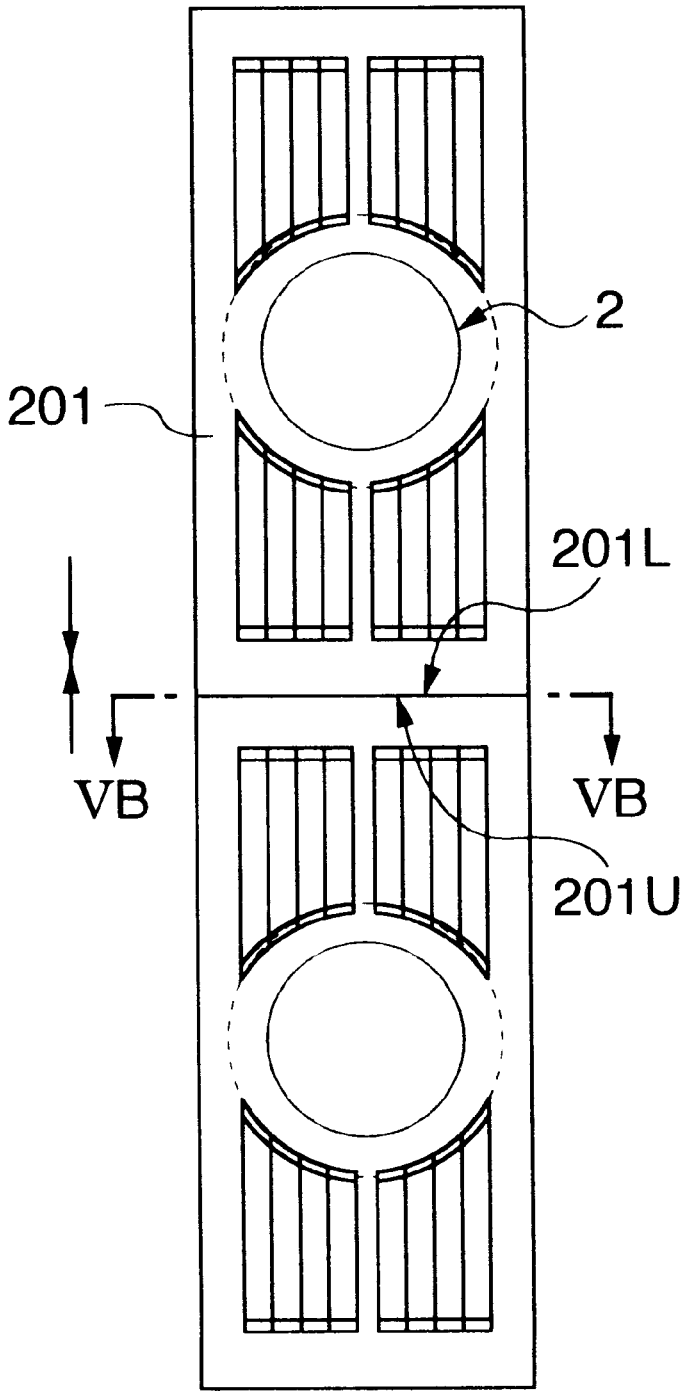
FIG. 5A is an enlarged view of the independent fin tube heat exchanger according to a second embodiment of the present invention wherein upper and lower ends of fins are not bent but inclined.
Figure 5B:
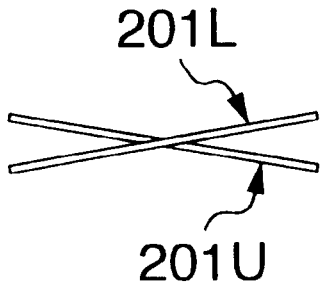
FIG. 5B is a sectional view taken along VB—VB line in FIG. 5A.

A second embodiment of the present invention will be described with reference to FIGS. 5A and 5B. In the first embodiment described above, the fins are bent at their upper and lower ends in the direction of their thickness. In the second embodiment, upper ends 201U and lower ends 201L of fins are slanted in directions reverse to each other in a direction of thickness of the fins (the portions which are bent in the first embodiment are twisted) so as not to be perpendicular to the transfer tube so that the ends of the fins are brought into contact as shown in FIG. 5B and will not bite each other. In other respects, the second embodiment has a structure which is the same as that of the first embodiment. In the second embodiment also, a similar advantageous effect is obtained by slanting not only the upper and lower ends but the fins as wholes. In this case, the through holes through which a heat transfer tube is to be inserted must be twisted in advance at a predetermined angle.

Figure 6A:
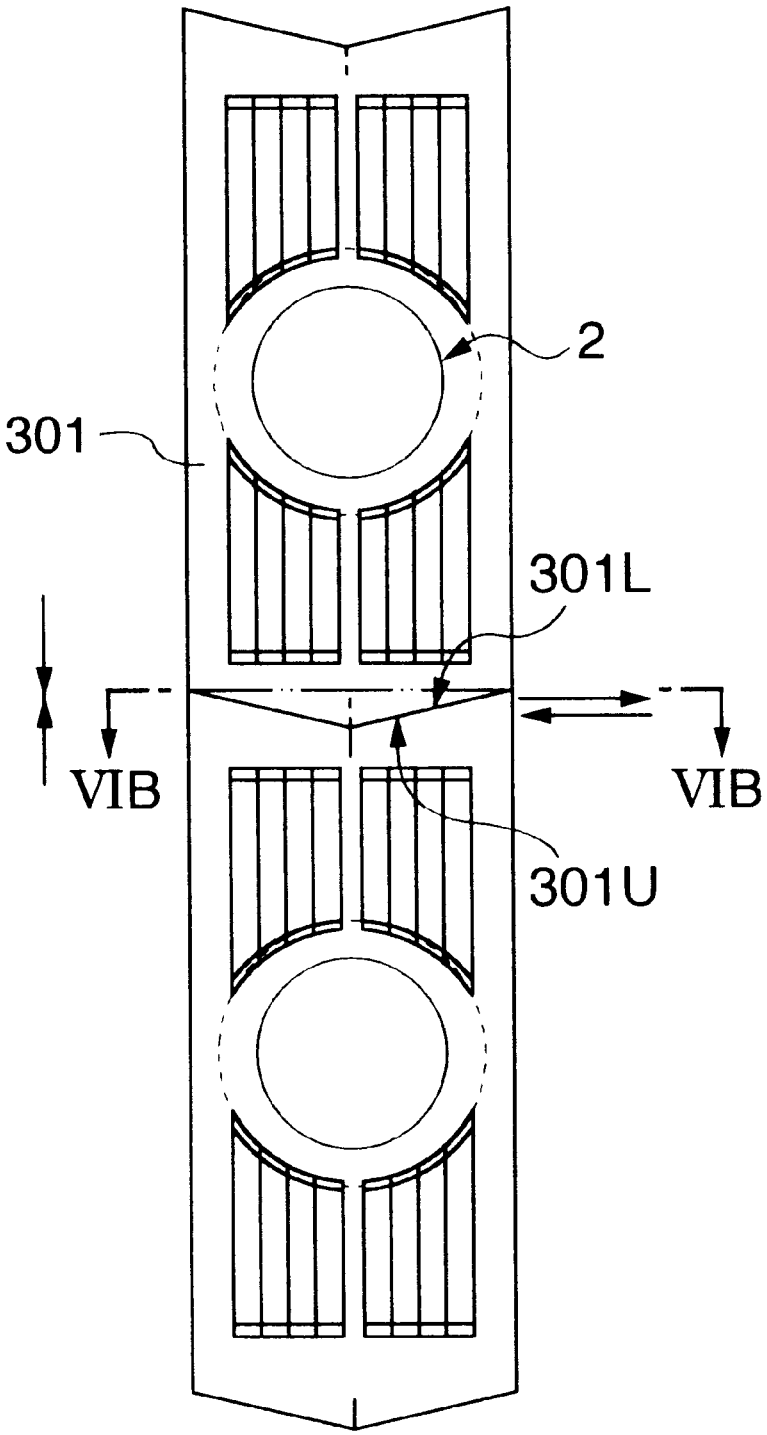
FIG. 6A is an enlarged view of the independent fin tube heat exchanger according to a third embodiment of the present invention wherein upper and lower ends of fins are concaved and convexed formed so as to intersect with each other.
Figure 6B:
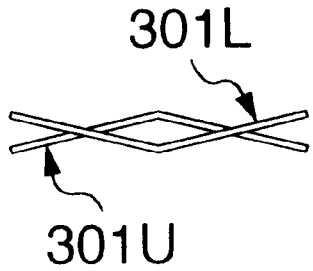
FIG. 6B is a sectional view taken along VIB—VIB line in FIG. 6A.

A third embodiment of the present invention will be described with reference to FIGS. 6A and 6B. In the first and second embodiments described above, the straight lower ends and upper ends of the fins are bent or twisted. In the third embodiment, straight ends 301U and 301L are cut into a V shape and then bent or twisted. In other respects, the third embodiment has a structure which is the same as that of the first or second embodiment. It is possible to form the ends of the fins not in the V shape but in a W shape or a zigzag shape so that the fins have a larger number of concavities and convexities. When the concavities and convexities are formed in a larger number, it is possible to arrange upper and lower fins at locations deviated in a direction of depth or enhancing freedom in arrangement thereof.

The concavities and convexities restrict horizontal movements of the fins, thereby remarkably enhancing a water dripping property and strength of the heat exchanger. Further, each pair of fins are brought into contact with each other at two points and an upper fin joins or bites to or into a lower fin as shown in FIG. 6B, thereby further enhancing strength of the heat exchanger.

Figure 7A:
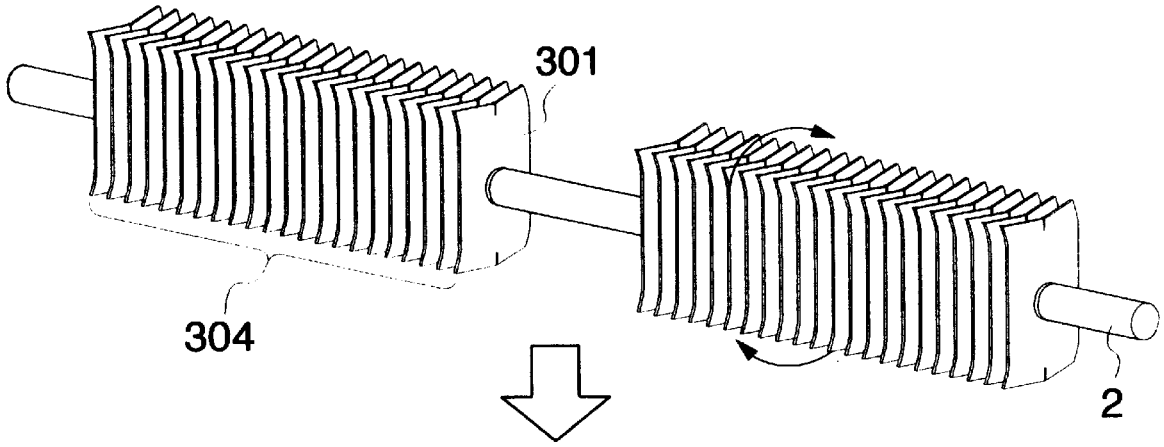
FIGS. 7A through 7C are illustrations of a manufacturing method of the independent fin tube heat exchanger shown in FIGS. 6A and 6B.
Figure 7B:
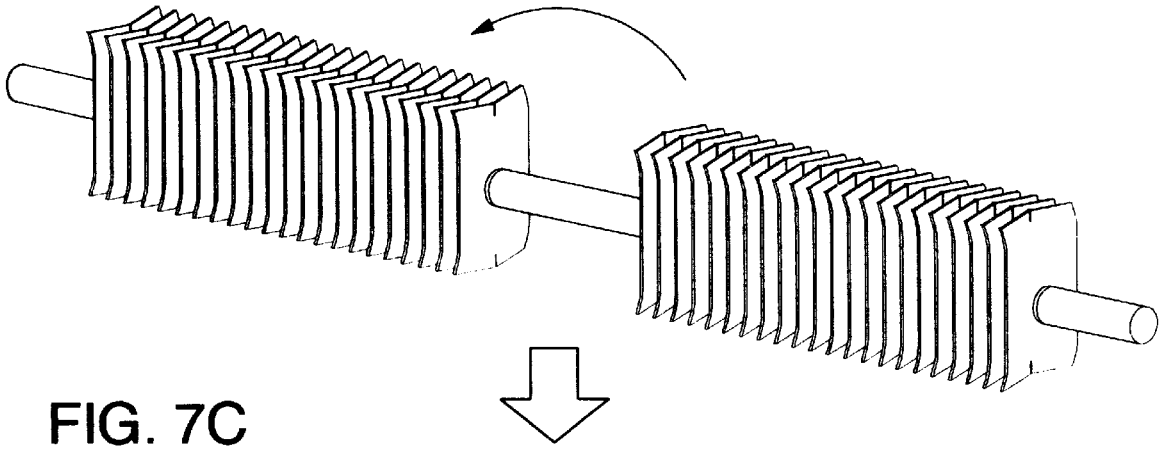
Figure 7C:
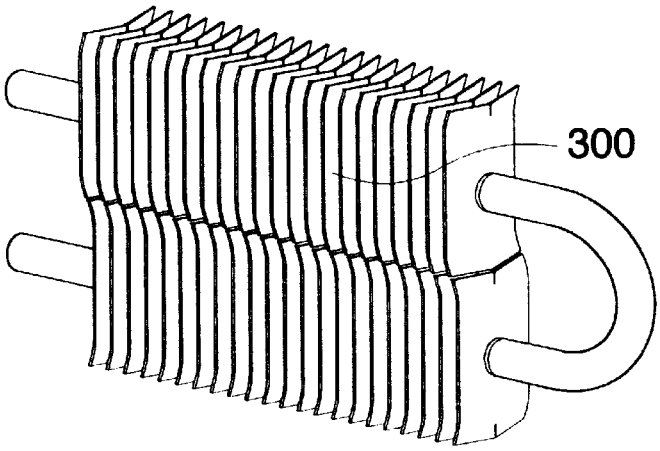

A manufacturing method of the heat exchanger which has the concavities and convexities will be described with reference to FIGS. 7A through 7C. Independent fins can be manufactured by a method which is quite the same as that of the fins which have the straight ends shown in FIGS. 3A through 3C. Though the steps from the insertion of a heat transfer tube to the formation of several fin blocks 304 are similar to those of the manufacturing method described above, it is necessary in this embodiment to expand a heat transfer tube 2 after turning the fin blocks upside down alternately and bend the heat transfer tube 2 (pipe) as shown in FIG. 7B. When the fin blocks are turned upside down alternately, it is possible to arrange so that the upper fin and lower fin intersect with each other when the fin blocks are piled up as shown in FIG. 7C.

Figure 8A:
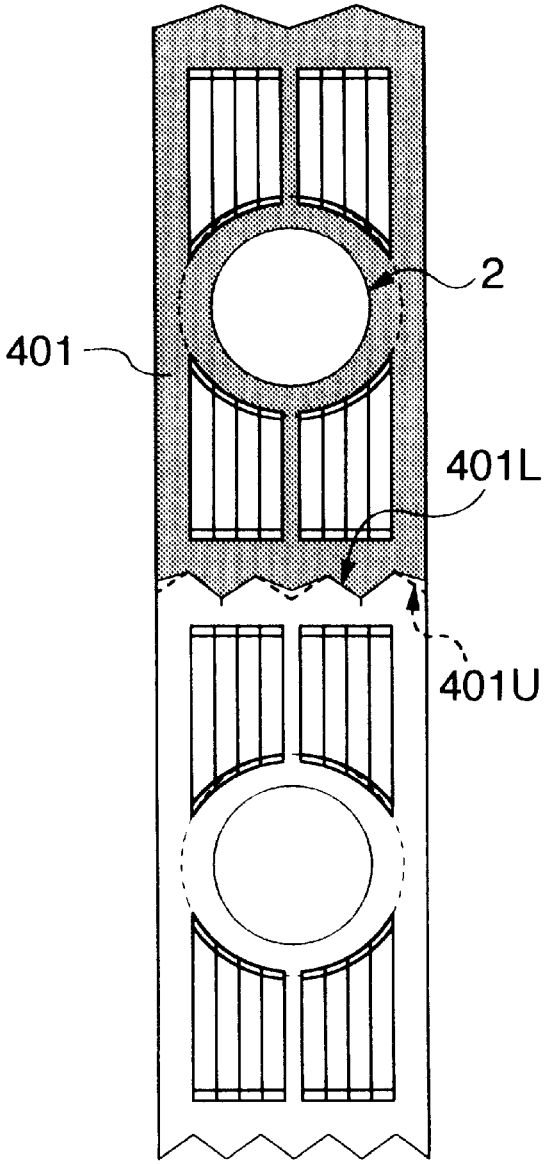
FIG. 8A is en enlarged view of the independent fin tube heat exchanger according to a fourth embodiment of the present invention wherein lower ends of upper fins bite into lower fins.
Figure 8B:
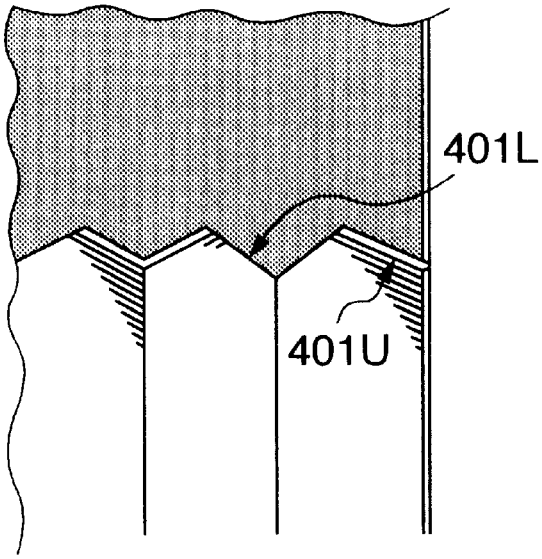
FIG. 8B is an enlarged view of biting portions of the upper and lower fins in FIG. 8A.

A fourth embodiment of the present invention will be described with reference to FIGS. 8A and 8B. The fourth embodiment is an example wherein resistance of the heat exchanger is further enhanced. A lower end 401L of an independent fin used in the fourth embodiment is formed so as to have protruding V-shaped portions, irregularities including V-shaped cuts or a zigzag form, whereas an upper end 401U of the fin is bent at a pitch twice as large as that of the concavities and convexities of the lower end of the fin in a direction of thickness of the fin. When fins which have ends described above are arranged at an upper stage and a lower stage so that they are brought into contact with each other, the lower end 401L which has the V-shaped concavities and convexities is fixed in a condition where it bites alternately with a front surface and a rear surface of the bent upper end 401U of the lower fin. In this case, the fins are restricted not only in the horizontal direction but also in a direction of thickness of the fin, whereby strength of the heat exchanger is enhanced remarkably. A water dripping property is also extremely favorable since condensated water flowing down the upper fin is drawn into the bent rear portion of the lower fin.

Though the fins which are used in the first through fourth embodiments described above are configured so as to have the surface shape as that of the slit fins, it is needless to say that the present invention exhibits quite the similar effects when it is applied to fins having other surface shapes such as those of fins, for example, cellular striation fins or fins which have turbulent flow accelerators.

Figure 9:
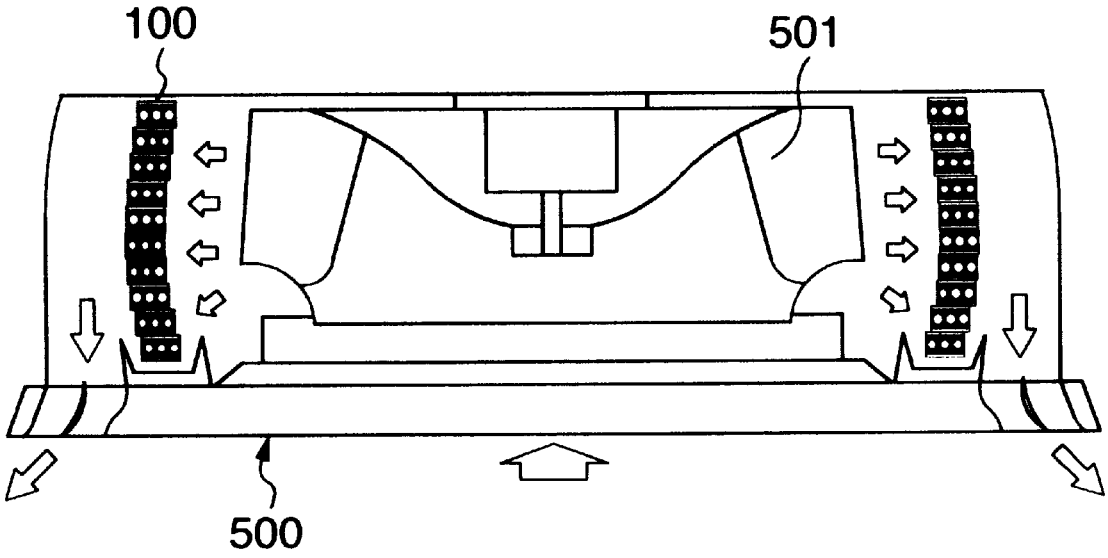
FIG. 9 is an illustration of an indoor unit of a package air conditioner which uses the heat exchanger according to a fifth embodiment of the present invention.

Now, an embodiment wherein the independent fin tube heat exchanger 100 preferred as the first embodiment is applied to an indoor unit of a package air conditioner will be described with reference to FIG. 9. Needless to say, not only the heat exchangers preferred as the first embodiment but also the heat exchangers preferred as the second, third and fourth embodiments can be used in indoor units of package air conditioners.

The heat exchanger 100 is disposed so as to surround a fan 501. Air is sucked from a lower portion of an indoor unit, flows through the fan and the heat exchanger, and is blown out of a blow-off port. Since the air flows through a narrow unit while winding, there is raised a problem that a ventilation resistance is increased. A sectional area of a wind path located over the blow-off port in particular raises a problem. Further, there is raised a problem that noise is enhanced due to interference between the heat exchanger and the fan when they are installed at a short distance. For developing an air conditioner which has high performance and produces low noise, it is desirable to configure a wind path so as to have a sectional area as large as possible, and install the fan and the heat exchanger apart as far as possible.

When the independent fin tube heat exchanger is used, it is possible to dispose the heat exchanger in the bent condition as described above so as to reserve a long distance from the fan while reserving a large sectional area of a wind path. Further, the independent fin tube heat exchanger permits freely selecting a zigzag arrangement or a checkers arrangement, thereby making it possible to obtain a high performance air conditioner which reduces windage loss dependently on wind speed distributions. Further, the independent fin tube heat exchanger which can be configured in various forms by bending an independent fin tube provides an effect to eliminate the necessity to manufacture different heat exchangers matched with volumes of indoor units to which they are applied.

Figure 10A:
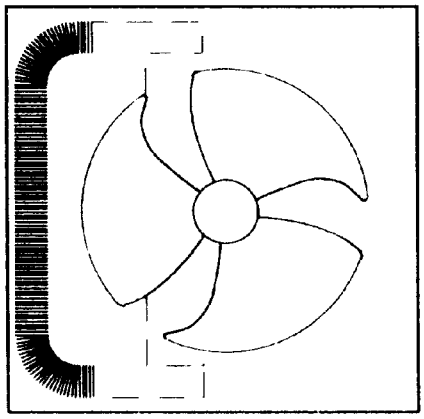
FIG. 10A is a top view of an outdoor unit of a package air conditioner using a heat exchanger according to a sixth embodiment of the present invention.
Figure 10B:
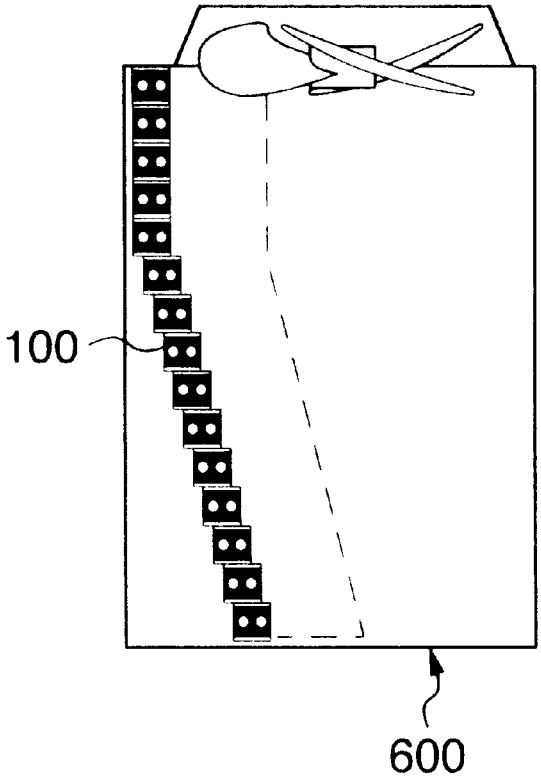
FIG. 10B is a side elevational view of the outdoor unit of the package air conditioner shown in FIG. 10A.
Figure 10C:
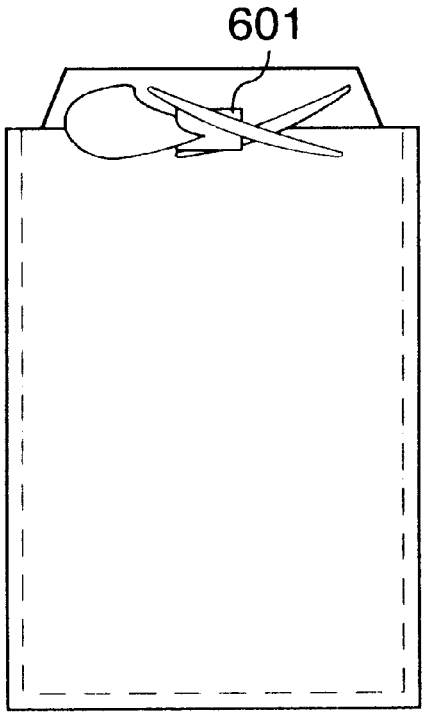
FIG. 10C is a rear view of the outdoor unit of the package air conditioner shown in FIG. 10A.

FIGS. 10A and 10B show an outdoor unit of a package air conditioner which uses the independent fin tube heat exchanger 100 preferred as the first embodiment. It is needless to say that not only the heat exchanger preferred as the first embodiment but also those preferred as the second, third and fourth embodiments are usable in outdoor units of package air conditioners.

The heat exchanger 100 can easily be formed even when it is to be disposed in a position inclined relative to the unit 600. When the heat exchanger 100 is inclined, it has an enlarged heat transfer area and improved performance, thereby making it possible to uniformalize heat exchangers which are conventionally manufactured so as to be matched with outdoor units having different volumes and lower manufacturing costs thereof. Further, the heat exchanger 100 has an enlarged front surface area, thereby slowing down a speed of wind passing through the heat exchanger and contributing to lower noise.

Figure 11:
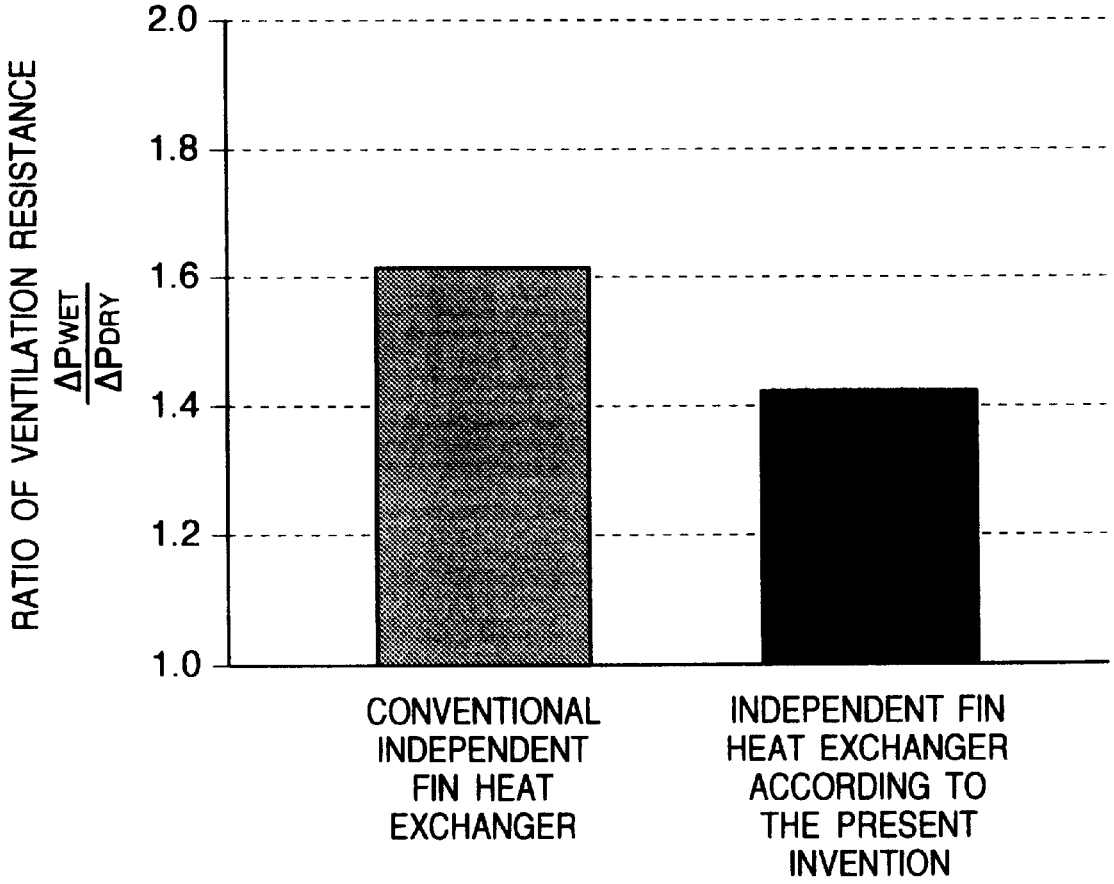
FIG. 11 is a diagram of a ratio of ventilation resistance in the heat exchanger according to the present invention when it is used as an evaporator.

Finally, a performance of the independent fin tube heat exchanger according to the present invention used as an evaporator will be described with reference to FIG. 11. Since moisture vapor contained in air is condensed on surfaces of fins in an evaporator, condensed water is held in a heat exchanger when it has a low water dripping property, thereby increasing ventilation resistance. FIG. 11 shows ratios of ventilation resistance in wet conditions relative to that in dry conditions of the conventional independent fin tube heat exchanger and the independent fin tube heat exchanger according to the present invention. A lower ratio of ventilation resistance indicates a higher water dripping property or higher performance of a heat exchanger. It will be understood that the independent fin tube heat exchanger according to the present invention has a ratio of ventilation resistance on the order of 1.4 which is nearly equal to that of a cross fin tube heat exchanger using continuous fins.

Though the heat exchanger is formed by inserting a plurality of fins over a heat transfer tube and bending the heat transfer tube in each of the embodiments described above, the present invention is applicable to a heat exchanger which is provided by forming a plurality of run-through holes in each fin for inserting a plurality of heat transfer tubes, inserting the fin in a plurality over a plurality of heat transfer tubes and bending these heat transfer tubes so as to bring lower ends of upper fins into contact with upper ends of lower fins as described above.

Though the heat exchanger is formed by inserting a plurality of fins over a heat transfer tube so as to form a plurality of fin blocks and bending the heat transfer tube into a U form between the fin blocks in each of the embodiments described above, the present invention is applicable also to a heat exchanger which is formed by inserting a plurality of fins over one or a plurality of heat transfer tubes so as to form a fin block, piling up such heat blocks in the direction of gravity and forming a refrigerant flow path by connecting the heat transfer tubes of the fin blocks with connecting tubes.

The present invention makes it possible to obtain an independent fin heat exchanger which has fins disposed independently for each heat transfer tube and strength enhanced while maintaining a desired water dripping property. Further, even if the air conditioner provides with a casing having various shapes, the air conditioner can be provided while obtaining a desired performance.

What is claimed is:

1. A heat exchanger provided by stacking a plurality of heat exchanger units each of which is formed by inserting a plurality of fins over one or a plurality of heat transfer tubes, wherein each of said fins has a collar through which the heat transfer tube passes and a plurality of slits, and is worked so that each fin of one of a pair the stacked heat exchanger units and an adjacent fin of another of the pair of stacked heat exchanger units are brought into contact with each other at a plurality of points, and wherein said fins are flat at areas around said collars and slits.

2. A heat exchanger according to claim 1, wherein each fin has a non-linear sectional shape at least at one end thereof.

3. A heat exchanger according to claim 1, wherein each fin is twisted so that its end is not perpendicular to said heat transfer tube.

4. A heat exchanger according to claim 1, wherein the heat exchange units are stacked by bending the heat transfer tube or tubes between said heat exchanger units so as to pile up said heat exchanger units.

5. A heat exchanger according to claim 1, wherein said fins have ends which are bent nearly at their centers in a direction of thickness of said fins on an overlapped side of said heat exchanger units so that a pair of opposed fins of the overlapped heat exchanger units are located in a condition wherein they are bent in directions reverse to each other and kept in contact with each other at two points.

6. A heat exchanger according to claim 1, wherein the heat exchange units are stacked by bending the heat transfer tube or tubes between said heat exchanger units so that the heat exchanger units are piled up, and wherein at least one end of each fin has a non-linear sectional shape.

7. A heat exchanger provided by piling up a plurality of heat exchanger units each of which is formed by inserting a plurality of fins over one or a plurality of heat transfer tubes, wherein said fin has a protruding V shape at an end to be piled up and a V-shaped cut at the other end, and is bent in a direction of thickness thereof so that the V-shaped ends of a pair of fins of said piled heat exchanger units are brought into contact with each other at two points.

8. A heat exchanger according to claim 7, wherein said protruding V shape and said V-shaped cut are formed in a plurality at the ends of said fin so that the protruding V shapes and the V-shaped cuts are engaged with each other in an overlapped condition.

9. An air conditioner comprising a fan and a heat exchanger disposed in a casing, wherein said heat exchanger comprises the heat exchanger according to claim 8.

10. An air conditioner according to claim 9, wherein a heat exchanger unit overlapped at an upper stage is disposed so as to be deviated from a heat exchanger unit overlapped at a lower stage.

* * * * *